United States Patent [19]

Randolph

[11] Patent Number: 4,528,913

[45] Date of Patent: Jul. 16, 1985

[54] GRAVITY OUTLET SLIDING GATE SEAL

[75] Inventor: Robert W. Randolph, St. Charles, Mo.

[73] Assignee: ACF Industries, Incorporated, Earth City, Mo.

[21] Appl. No.: 433,331

[22] Filed: Oct. 7, 1982

[51] Int. Cl.[3] ..... B61D 7/20; B61D 7/22

[52] U.S. Cl. ..... 105/282 A; 105/424

[58] Field of Search ..... 105/282 A, 282 R, 282 P, 105/424, 305, 308 A

[56] References Cited

U.S. PATENT DOCUMENTS

| | | | |
|---|---|---|---|
| 2,317,007 | 4/1943 | Weni | 105/282 P X |
| 2,386,702 | 10/1945 | McBride | 105/282 P |
| 3,255,714 | 6/1966 | Dorey | 105/282 P X |
| 3,385;232 | 5/1968 | Dorey | 105/282 A X |
| 3,415,204 | 12/1968 | Pase | 105/424 X |
| 3,596,611 | 8/1971 | Floehr | 105/282 A |
| 3,958,514 | 5/1976 | Akester et al. | 105/282 A |
| 4,325,308 | 4/1982 | Erfurth | 105/282 A X |

*Primary Examiner*—Robert B. Reeves
*Assistant Examiner*—Dennis Rodgers
*Attorney, Agent, or Firm*—Polster, Polster and Lucchesi

[57] ABSTRACT

The sealing assembly (10) of the present invention comprises a resilient sponge rubber tube (12) supported and retained by a metal bar (14) running through the tube and extending through slots (16) in the outlet side frame (18) terminating at each end in a retaining assembly (20). The seal member-slot relationship is such that when the gate (30) is open (FIG. 1), the seal member (12) rests on the gate with its retaining bar (14) in the lower portion of the side frame slots (16). Should there be an obstruction on the gate (not shown) such as adhering lading, the seal (12) when forced toward the outlet pan (40) will cause the retaining bar to rise in the slot to position (**16*b*). This movement will allow the seal to ride over the obstruction and prevent the seal (12) from being pinched in the clearance slot (34) above the gate. As the gate is fully closed the upturned flange (32) at the back edge of the gate compresses the seal (12) against the outlet pan (40). As the seal (12) is compressed, the support bar (14) travels in the slot (16) at each end to the position (16*b***) allowing the seal to be compressed uniformly.

5 Claims, 4 Drawing Figures

GRAVITY OUTLET SLIDING GATE SEAL

BACKGROUND OF THE INVENTION

In sliding gate gravity outlets it has been found that careful attention to the flatness of the gate and its supporting structure will produce satisfactory sealing at the leading edge and the sides of the gate.

The trailing edge of the gate passes through a slot in the outlet pan which must be of such size as to allow the gate to slide without binding under the minimum tolerance conditions. This clearance is increased by the allowable manufacturing tolerances. This clearance can amount to as much as six square inches of opening.

The Association of American Railroads (AAR) has issued a specification on gravity outlets which includes an acceptance test which provides that the outlet is acceptable if it will retain any part of fifty (50) gallons of water for a period of three (3) minutes.

With the slot condition which exists such outlets will not pass this acceptance test without a seal which closes off this slot.

This open slot also allows considerable escape of fine powders such as cement and flour as dust when handling such materials.

Several types of seals, such as the "P" seal described in U.S. Pat. No. 3,958,514 and a blade seal used on a gravity outlet have been used.

While use of these seals have allowed the outlets to meet the water test and reduce dusting, they have the disadvantage of short life, increased drag on the gate and high cost.

OBJECT OF THE INVENTION

It is the object of this invention to provide a seal assembly which provides relatively long life, and relatively trouble free service at low cost.

Another object is to provide a seal assembly which reduces or eliminates drag on the gate.

SUMMARY OF THE INVENTION

The sealing assembly of the present invention comprises a resilient sponge rubber tube supported and retained by a rigid bar running through the tube and extending through slots in the outlet side frame terminating at each end in a retainer such as a washer and cotter pin to hold the seal and bar in place.

The seal member-slot relationship is such that when the gate is in open position (FIG. 1), the seal member rests on the gate with its retaining bar in the lower portion of the side frame slots.

In one embodiment, the slot is so positioned that, as the gate is closed, the retaining bar has the tendency to remain in the bottom of the slot. Should there be an obstruction on the gate (not shown) such as adhering lading, the seal when forced toward the outlet pan will cause the retaining bar to rise in the slot to position **16*b***. This movement will allow the seal to ride over such obstruction and prevent the seal from being pinched in the clearance slot above the gate by such obstruction.

As the gate is fully closed, the upturned flange at the back edge of the gate compresses the seal against the outlet pan.

In one embodiment the general slope of the pan is 3°–15° less than the slope of the upturned flange. This difference in slope forms a pocket in which the open top is narrower than the center of the seal area, and effectively restrains the seal in this pocket. As the seal is compressed, the support bar travels in the slot at each end to the position (**16*b***) allowing the seal to be compressed uniformly without being extruded into the slot.

The seal material is preferably closed cell sponge rubber with a fully closed outside skin. One suitable material is neoprene rubber.

THE DRAWINGS

DESCRIPTION OF PREFERRED EMBODIMENTS

Figure 1:
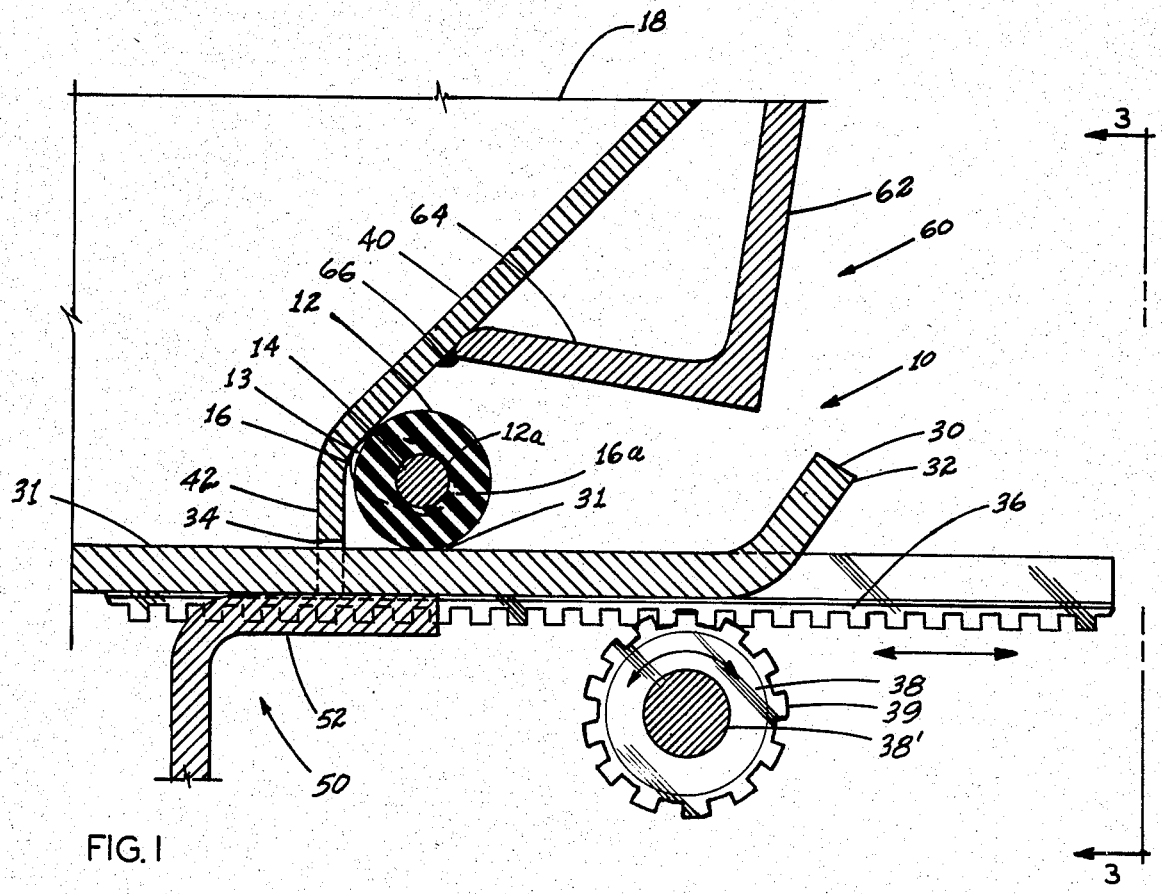
FIG. 1 is a vertical sectional view of the seal assembly of the present invention with a gate in an open position.

The gravity outlet seal assembly of the present invention 10 includes a seal member 12 which extends transversely of the outlet below a pan outlet end sheet 40 having a lower vertical extension 42. An outlet support 50 having a horizontal portion 52 supports a movable gate 30 which is movable back and forth between open and closed positions illustrated respectfully in FIGS. 1 and 2. There exists clearance 34 above the top surface 31 of the gate.

The sealing member 12 is generally circular in cross section and includes an internal opening **12*a* which receives a supporting transverse bar 14** also conveniently of circular cross section.

The sealing member is conveniently made of sponge rubber such as neoprene. In addition, an external skin 13 is desirable. Preferably the sponge rubber is of the closed cell type. In open position the seal member 12 rests upon the gate 31.

Figure 3:
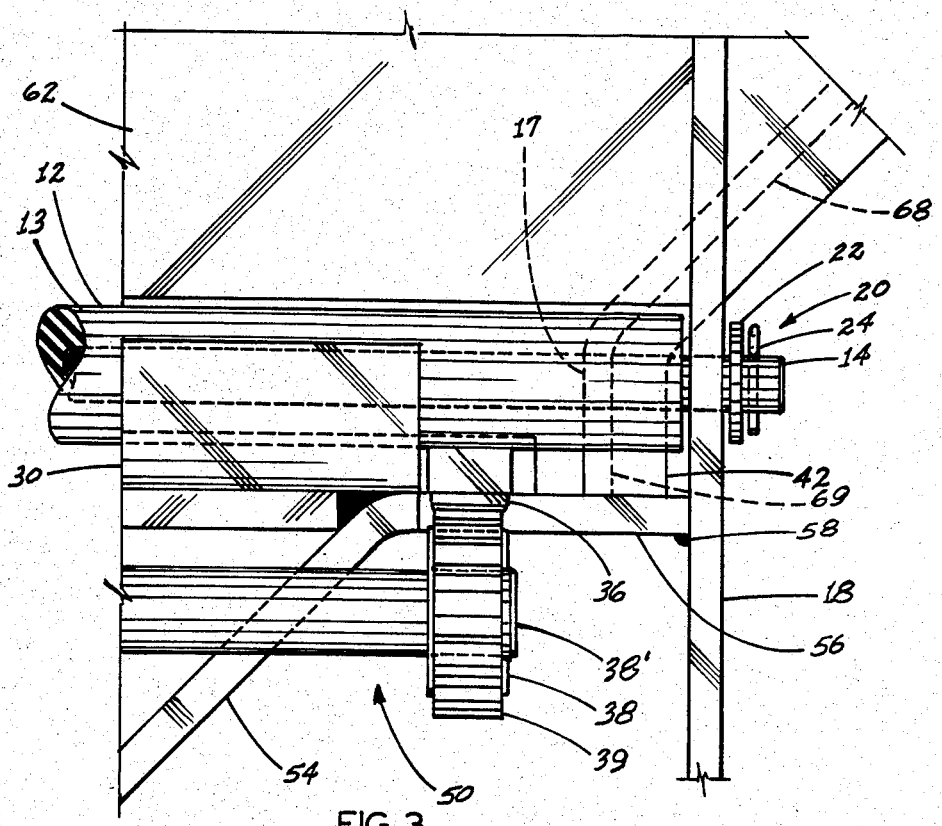
FIG. 3 is a partial end view illustrating the retainer for the seal and support bar in place.
Figure 4:
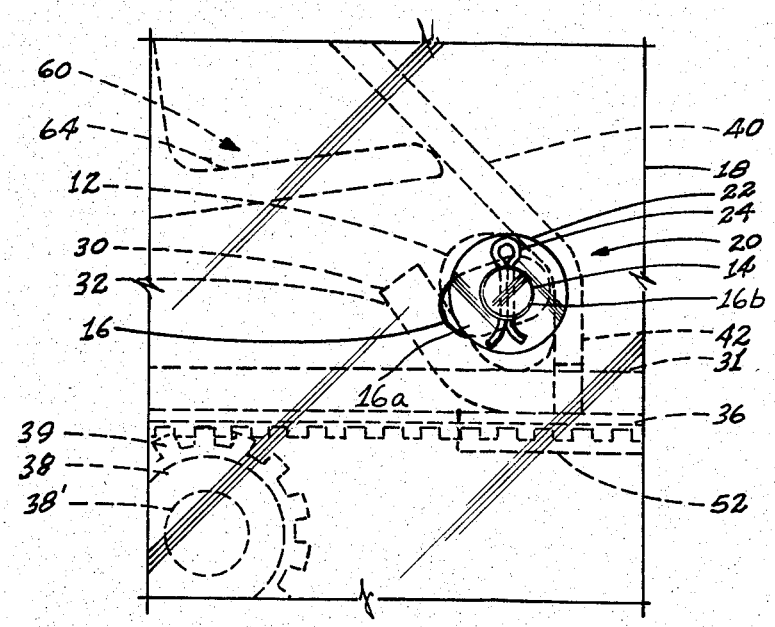
FIG. 4 is a side view of FIG. 3 illustrating the slot in one side support and a cotter pin for retaining the support bar.

As shown in FIG. 3 the seal member 12 extends to respective ends 17 of the outlet. At each end of the outlet the support bar 14 extends through a support 18. A slot 16 is provided in the support 18. Slot 16 is generally elongated as illustrated in FIG. 4. Retaining means 20 such as a washer 22 and a cotter pin 24 hold the support bar in place within the support 18.

It is also apparent from FIG. 3 that the outlet portion 50 includes an inclined portion 54 having a horizontal end portion 56 which supports the gate 30. Support portion 56 is welded to side support 18 at 58.

An optional pan reinforcement member 60 (FIG. 1) of angle shape having legs 62 and an inwardly extending leg 64 may be provided which is welded to the pan at 66.

Also as is conventional the pan includes pan side sheets 68, having lower vertical portions 69 which are located outwardly of the moving gate 30.

FIG. 1 shows the position of the seal member 12 when the gate is in a partially open or full open position. The seal member is supported by the gate top surface 31. The support bar 14 is in a lower position **16*a* within the slot 16. In this position the seal is free to rotate on the gate but is not movable longitudinally with the gate. The gate is movable between open and closed positions in any convenient manner. For example, a rack 36 may be welded to or formed integrally with the gate extension 32. A pinion 38 rotatable but longitudinally fixed may be provided and rotated by a suitable operating bar or gear mechanism (not shown) in a known manner. Preferably the pinion shaft 38' extends transversely and preferably includes teeth 39 at either side of the outlet. Preferably racks 36 are located at each side of the outlet to apply the pinion force evenly to the gate 30**.

Figure 2:
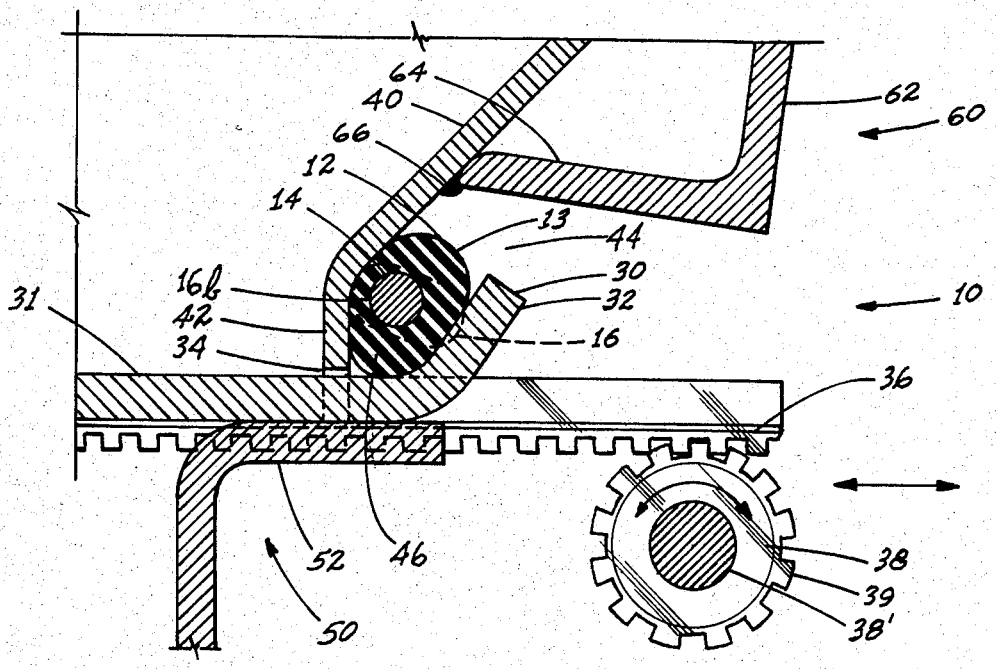
FIG. 2 is a vertical sectional view of the seal assembly of the present invention with the gate in a closed position.

As the gate assumes the closed position illustrated in FIG. 2 the gate extension 32 engages the seal member 12 and compresses the seal member to an elongated configuration illustrated in FIG. 2. As this occurs the support bar 14 is movable from the lower position 16*a* in the slot 16 to the upper position 16*b* shown in FIG. 2, and also illustrated in FIG. 4. It will be apparent that the slot 16 allows the necessary movement of the bar 14 to enable the seal to assume the elongated closed position shown in FIG. 2.

Moreover, should there be an obstruction on the gate, such as adhering lading or hardened cement, the seal 12 when forced toward the outlet pan 40 will cause the retaining bar 14 to rise in the slot 16. This movement along the slot allows the seal 12 to ride over such obstruction without being pinched in the clearance 34 between the gate and the bottom of the pan extension 42.

The slope 33 which the gate end 32 defines with the gate surface 31 an angle which is greater than the angle which the pan end sheet makes with the horizontal. Preferably this angle increase is at least 2° and need not exceed 15°. This angular relationship results in an open pocket 44 that is narrower than the center of the seal area 46. This effectively restrains the seal in the pocket 44.

It also will be appreciated that as the seal is compressed and the support bar 14 travels in the slot 16 at each end, the seal is compressed uniformly across the gate. Thus there is less tendency for there to be gaps for lading or liquid to escape in the closed position.

The seal assembly of the present invention has been tested and it has been found that this seal assembly will pass the AAR specification for gravity outlets which requires that outlets retain a portion of 50 gallons of water for a period of three minutes.

Furthermore, seal 14 is free to roll on gate 31 as the gate is opened and closed. Rolling reduces the friction (drag) between the gate 31 and seal 14. This rolling action also reduces abrasive action of residue of lading on the gate against the seal and should promote long life.

Thus it is seen that the outlet of the present invention has achieved an important objective insofar as the AAR specification is concerned.

What is claimed is:

1. In a hopper discharge outlet for a railway hopper car or the like comprising a hopper structure converging downwardly and defining an opening for the discharge of a lading from within said hopper car, said hopper structure having a gate movable between a closed position in which the lading is blocked from being discharged from said discharge opening and an open position in which the lading may be discharged via the discharge opening, means for moving said gate between its open and closed positions, wherein the improvement comprises: seal means carried by said hopper structure engageable with said gate when the latter is in its closed position thereby to substantially seal said gate with respect to said hopper structure, said seal means being journaled relative to said hopper structure for rolling on said gate as the latter is moved between its closed and its opened positions, said seal means being mounted with respect to said hopper structure for moving away from said gate upon an obstruction, such as hardened lading or the like, on said gate engaging said seal means and for moving toward said gate after said obstruction has passed said seal means as said gate is moved between its opened and closed positions.

2. In a hopper discharge outlet as set forth in claim 1 wherein said seal means comprises a tubular member of a suitable elastomeric sealant material, and a support axle disposed within said tubular member, the ends of said axle being journaled with respect to said hopper structure for rolling of said tubular member on said gate as the latter is moved between its opened and closed positions.

3. In a hopper discharge outlet as set forth in claim 2 wherein said hopper structure includes a slot therein for receiving and for journaling a respective end of said axle, each of said slots being inclined up away from the horizontal in the direction of movement of said gate from its opened to its closed position.

4. In a hopper discharge outlet as set forth in claim 2 wherein said gate includes an inclined portion protruding from the plane of movement of said gate, said seal means being engageable by said hopper structure and said inclined gate portion upon said gate being moved to its closed position thereby to compress said seal means and to effect a seal between said gate, said seal means, and said hopper structure.

5. In a hopper discharge outlet as set forth in claim 4 wherein said hopper structure includes a pan sloping downwardly toward said discharge opening at a predetermined pan slope angle, and wherein said inclined gate portion is inclined at a predetermined gate slope angle in generally parallel relation to said pan slope angle, but with said pan slope angle being somewhat less than said gate slope angle such that a pocket is formed therebetween for receiving said seal means, with the top of said pocket being somewhat narrower than the bottom thereof.

* * * * *